US010254056B2

(12) United States Patent
Steurer et al.

(10) Patent No.: US 10,254,056 B2
(45) Date of Patent: Apr. 9, 2019

(54) HEAT EXCHANGER

(75) Inventors: Hans-Ulrich Steurer, Stuttgart (DE); Peter Geskes, Ostfildern (DE); Christian Saumweber, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 1403 days.

(21) Appl. No.: 12/789,988

(22) Filed: May 28, 2010

(65) Prior Publication Data

US 2010/0300647 A1 Dec. 2, 2010

(30) Foreign Application Priority Data

May 28, 2009 (DE) ..... 10 2009 022 986

(51) Int. Cl.

| | |
|---|---|
| ***F28F 17/00*** | (2006.01) |
| ***F28D 7/16*** | (2006.01) |
| ***F28F 3/02*** | (2006.01) |
| ***F28D 21/00*** | (2006.01) |
| *F28F 9/02* | (2006.01) |

(52) U.S. Cl.

CPC ..... *F28F 17/005* (2013.01); *F28D 7/1684* (2013.01); *F28D 21/0003* (2013.01); *F28F 3/025* (2013.01); *F28D 2021/0082* (2013.01); *F28F 9/0265* (2013.01); *F28F 9/0282* (2013.01); *F28F 2009/029* (2013.01)

(58) Field of Classification Search

CPC ..... F25B 43/02; F25B 43/043; F25B 43/00; F28F 9/0246; F28F 9/0253; F28F 9/0282; F28F 2265/18; F28B 9/08; F01P 9/00

USPC .... 165/70–71, 110, 148, 151–153, 173–175, 165/52; 62/468

See application file for complete search history.

(56) References Cited

U.S. PATENT DOCUMENTS

| | | | | |
|---|---|---|---|---|
| 2,099,186 | A * | 11/1937 | Anderegg | 165/110 |
| 3,051,450 | A * | 8/1962 | White et al. | 165/110 |
| 3,063,682 | A * | 11/1962 | Greene et al. | 165/110 |
| 3,455,377 | A * | 7/1969 | Hayes | 165/110 |
| 4,336,837 | A * | 6/1982 | Koenig | 165/104.22 |
| 4,679,410 | A * | 7/1987 | Drayer | 62/503 |
| 5,172,758 | A * | 12/1992 | Aoki | 165/110 |
| 5,178,209 | A * | 1/1993 | Aoki et al. | 165/110 |
| 5,526,876 | A * | 6/1996 | Karube | 165/176 |
| 6,557,371 | B1 * | 5/2003 | Judge | 62/468 |

(Continued)

FOREIGN PATENT DOCUMENTS

| | | |
|---|---|---|
| DE | 36 01 391 A1 | 2/1987 |
| DE | 203 07 881 U1 | 9/2004 |

(Continued)

*Primary Examiner* — Christopher R Zerphey
*Assistant Examiner* — Harry Arant
(74) *Attorney, Agent, or Firm* — Muncy, Geissler, Olds & Lowe, P.C.

(57) ABSTRACT

A heat exchanger, in particular a charge air cooler or an exhaust gas cooler for an internal combustion engine, comprising a plurality of essentially parallel tubes and at least one collector box on the output side, the tubes each emptying into the collector box on the output side, and a gas flow flowing from the tubes into the collector box and from the collector box into an outlet of the collector box, a structure for interacting with the gas flow being provided at least one of the tubes or collector box, a condensation being transported to the outlet with the aid of the structure.

21 Claims, 7 Drawing Sheets

(56) References Cited

U.S. PATENT DOCUMENTS

| | | | | |
|---|---|---|---|---|
| 7,896,065 | B2 | 3/2011 | Augenstein et al. | |
| 2005/0022982 | A1 | 2/2005 | Dilley et al. | |
| 2008/0105420 | A1 | 5/2008 | Taras et al. | |
| 2009/0133860 | A1* | 5/2009 | Harada et al. | 165/151 |

FOREIGN PATENT DOCUMENTS

| | | | |
|---|---|---|---|
| DE | 10 2004 047 891 | A1 | 5/2005 |
| DE | 10 2005 047 440 | A1 | 4/2006 |
| DE | 20 2005 021 555 | U1 | 12/2008 |
| EP | 1373809 | A1 | 1/2004 |
| FR | 2 922 962 | A1 | 5/2009 |
| JP | 2002-295987 | A | 10/2002 |
| JP | 2007-051854 | A | 3/2007 |

* cited by examiner

HEAT EXCHANGER

This nonprovisional application claims priority under 35 U.S.C. § 119(a) to German Patent Application No. DE 10 2009 022 986.8, which was filed in Germany on May 28, 2009, and which is herein incorporated by reference.

BACKGROUND OF THE INVENTION

Field of the Invention

The invention relates to a heat exchanger, in particular a charge air cooler or an exhaust gas cooler for an internal combustion engine.

Description of the Background Art

Air charge coolers and exhaust gas coolers are known from automotive engineering practice, in which the compressed gas to be cooled is conducted through a plurality of exchanger tubes which extend between two collector boxes. In principle, a certain amount of liquid condensation accumulates due to the cooling of the gas flow. A large amount of condensation accumulates in systems such as a low-pressure exhaust gas recirculation system, since the gas flow supplied to the charge air cooler is made not only of air alone, but also of an exhaust gas/air mixture.

SUMMARY OF THE INVENTION

It is therefore an object of the present invention to provide a heat exchanger, in particular a charge air cooler or an exhaust gas cooler for an internal combustion engine, in which particularly large amounts of accumulating condensation are removed at least in a form that is distributed in an aerosol-like manner via the gas flow.

By providing the at least one structure according to the invention for interacting with the gas flow, accumulated condensation may be introduced into the gas flow in a vaporized form or in a form that is atomized in an aerosol-like manner in the area of the collector box on the outlet side, so that the condensation is removed through the outlet and does not accumulate in disturbing quantities in the heat exchanger. A system of this type is suitable, in particular, for a charge air cooler of an internal combustion engine. When cooling charge air, large amounts of condensation may accumulate in general and particularly in connection with an exhaust gas recirculation system. Condensation also accumulates when cooling exhaust gas in an exhaust gas cooler, depending on the operating conditions. A gas flow can be understood to be both charge air alone, an exhaust gas/air mixture or even exhaust gas alone.

In an embodiment of the invention, the structure includes a projection of tubes into the collector box. According to the conventional art, the ends of the tubes terminate flush with, for example, a base plate of the collector box. In a projection according to the invention, the tubes extend through the base piece into the collector box, so that the edge of the tubes is exposed to a gas flow and a distribution of condensation accumulating in the tube into fine droplets on the edge of the tube is promoted.

In an alternative or additional embodiment, the structure can include a modulation of an edge of at least one of the tubes on the outlet side, thereby improving atomization of the condensation driven by the gas flow in the tube at the edge of the tube. In a first possible detail design, the edge modulation may involve an upward bending of the edge, either an upward bending on only one side or also on two sides. By upward bending of the outlet edge, the flow cross-section for the gas flow is reduced so that a greater flow velocity forms locally which improves atomization of the condensation film. At the same time, an upward bending in a suitable direction may cause the gas flow to be deflected in the direction of the collector box outlet. This effect is intensified by also bending up the other outlet edge of the tube, which is usually designed as a flat tube. In an alternative or additional detail design, the tube edge may have a corrugation, for example in the manner of a crenellation or sinusoidal waves. A corrugation of this type generally improves the atomization of the condensation at the edge of the tube.

In a further alternative or additional embodiment of the invention, it is provided that the collector box can be designed as a longitudinal cavity, a cross-section of the collector box increasing over the area of the emptying tubes in the direction of the gas flow. Since volumetric flow rate increases along the collector box, due to the emptying tubes, enlarging the cross-section causes the flow velocity of the gas to be equalized over the length of the collector box. This may enable a condensation film on a wall of the collector box to be continuously driven in the direction of the outlet. Areas where the gas flow rate is unfavorably low in the area of the collector box wall are avoided and the transport of the condensation to the outlet is improved overall. In a preferred detail design, a wall of the collector box opposite the tubes is inclined in a direction that is perpendicular to the tubes, which enables the incident gas flow to be incident upon the wall in a grazing manner and to optimally drive the condensation film in the direction of the outlet, in particular against an effect of gravity.

In a further embodiment of the invention, the structure can include at least one conducting member provided in the collector box, the gas flow being guided, in particular, onto a wall of the collector box in a grazing manner with the aid of the conducting member. This achieves a uniformly high flow velocity, and a condensation film is driven on the collector box wall in the direction of the outlet. In a possible detail design, the conducting member is designed in a simple and cost-effective manner as a conducting plate, in particular as an aluminum sheet molded part. As an alternative or in addition, the conducting member is designed as a conducting vane, which is understood to be a molded part of variable diameter. A conducting vane of this type may be designed, for example, as a plastic injection-molded part. The provision of conducting vanes makes it possible to provide selected constrictions for the gas flow for the purpose of local acceleration.

In a further embodiment of the invention, the collector box can have a sump for the condensation, the structure being designed as at least one separation edge provided in the area of the sump. As a result, the condensation amount accumulating in the sump is more thoroughly atomized and removed via the gas flow flowing over the separation edge. Depending on the requirements, a separation edge of this type may run over an entire width of the box and it may be interrupted multiple times to produce turbulence or have other detail designs. Depending on the requirements, multiple separation edges may also be provided.

In a further embodiment of the invention, the collector box can have a sump for the condensation, the structure including a condensation channel which leads from the sump to the outlet, the gas flow passing over the end of the channel on the outlet side. This produces a lower static pressure in the area of the condensation channel outlet, by means of which the condensation is extracted from the sump.

In a possible detail design, a section of the condensation channel is designed as a separate line or as a line integrated into a wall of the collector box on either the inside or the outside, depending on the requirements. Depending on the requirements, it may also be provided that a retaining member is provided immediately above the sump for the purpose of influencing a pressure in the area of the sump, which further improves the delivery head in the condensation channel. In a particularly preferred detail design, the retaining member is designed to be easily and cost-effectively integrated into a wall of the condensation channel.

In a further possible detailed design, a nozzle-like cross-sectional constriction of the outlet is provided in the area of the end of the condensation channel on the outlet side, which increases the flow velocity of the gas flow and improves the suction effect at the condensation channel.

In a further embodiment of the invention, a turbulence member can be inserted into each of the tubes, however preferably not necessarily in the form of an inner fin, the turbulence member having a projection over the end of the tube and extending into the collector box. For example, a method in known from the manufacture of charge air coolers in which flat aluminum tubes are first cut to length during manufacture and an inner fin, such as a connecting fin, is inserted and subsequently cassetted with a base piece. Due to the simple and cost-effective feature of an excess length of the inserted inner fin, a projection of this type over the end of the tube and into the collector box on the output side may be achieved. The condensation accumulating on the inner wall of the flat tube is driven onto the turbulence member, which usually has a large surface, where it is atomized and/or vaporized into droplets by the gas flow present in the collector area.

In an embodiment, the projection of the turbulence member is provided with a bend, in particular in the direction of the outlet. This makes it possible to further improve the atomization of the condensation and equalize the gas flow in the collector box. The weighted projections of the turbulence members may thus perform the same or a similar function as a conducting member for influencing the gas flow in the collector box, for example to improve transport of a condensation film on a collector box wall in the direction of the outlet.

In general, it is provided that the collector box extends essentially in the direction of gravity, the tubes extending essentially in the horizontal direction. A design of this type is frequently desired, in particular for use in motor vehicles, the measures according to the invention for improving the condensation removal being particularly helpful.

It is understood that the features of the individual embodiments of the invention may be reasonably combined with each other in any manner.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
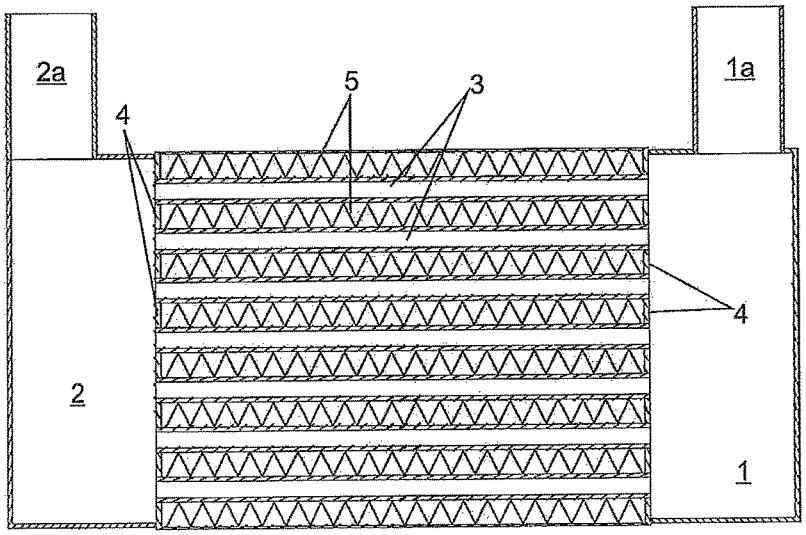
FIG. 1 shows a schematic sectional view of a heat exchanger in the form of a charge air cooler according to the prior art.

A heat exchanger designed as a charge air cooler according to the prior art (FIG. 1) comprises a collector box 1 on the input side having an inlet 1*a*, a collector box 2 on the output side having and outlet 2*a* and a plurality of tubes 3 extending in the horizontal direction between collector boxes 1, 2 in the form of flat aluminum tubes. Tubes 3 are accommodated in bases 4 of the collector boxes and terminate flush therewith.

Fins 5, through which cooling air flows (perpendicular to the plane of the drawing), are provided between flat tubes 3. The charge air cooler according to FIG. 1 is a direct charge air cooler for cooling using airstream. In principle, an indirect charge air cooler or the like may also be provided. The gas flow flows from inlet 1*a* through collector box 1 on the input side, is distributed to tubes 3, collected again in collector box 2 on the output side and then flows to outlet 2*a*. Condensation may accumulate, in particular, on the insides of tubes 3, this condensation accumulating mainly on the bottom of collector box 2 on the output side.

Figure 2:
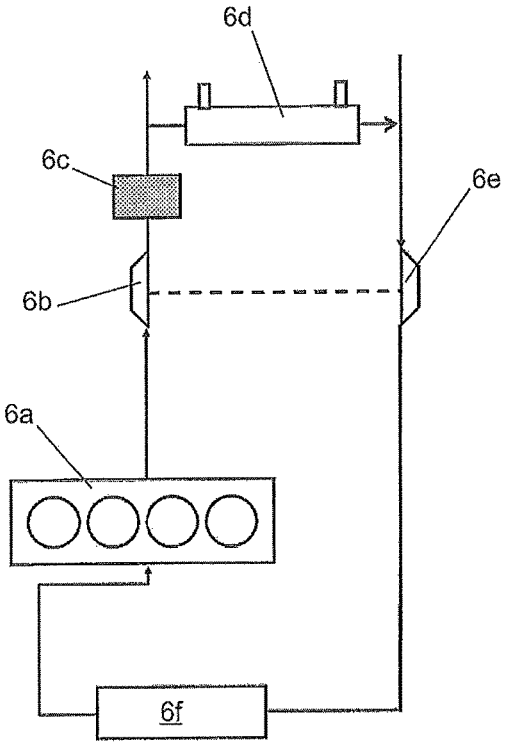
FIG. 2 shows a schematic representation of an internal combustion engine having a low-pressure exhaust gas recirculation system and a heat exchanger according to the invention in the form of a charge air cooler.

A particularly large amount of condensation accumulates if the charge air cooler is used as part of an exhaust gas recirculation system, as in FIG. 2, for example a low-pressure exhaust gas recirculation system or even a high-pressure exhaust gas recirculation system which is supplied upstream from the charge air cooler, or if an exhaust gas/air mixture flows through the charge air cooler in another manner.

The illustrated gas supply system includes an internal combustion engine 6*a*, an exhaust gas turbine 6*b*, a particle filter 6*c*, an exhaust gas cooler 6*d*, a compressor 6*e* and a charge air cooler 6*f* according to the invention, in which a mixture of compressed fresh air and added exhaust gas is cooled.

Figure 3:
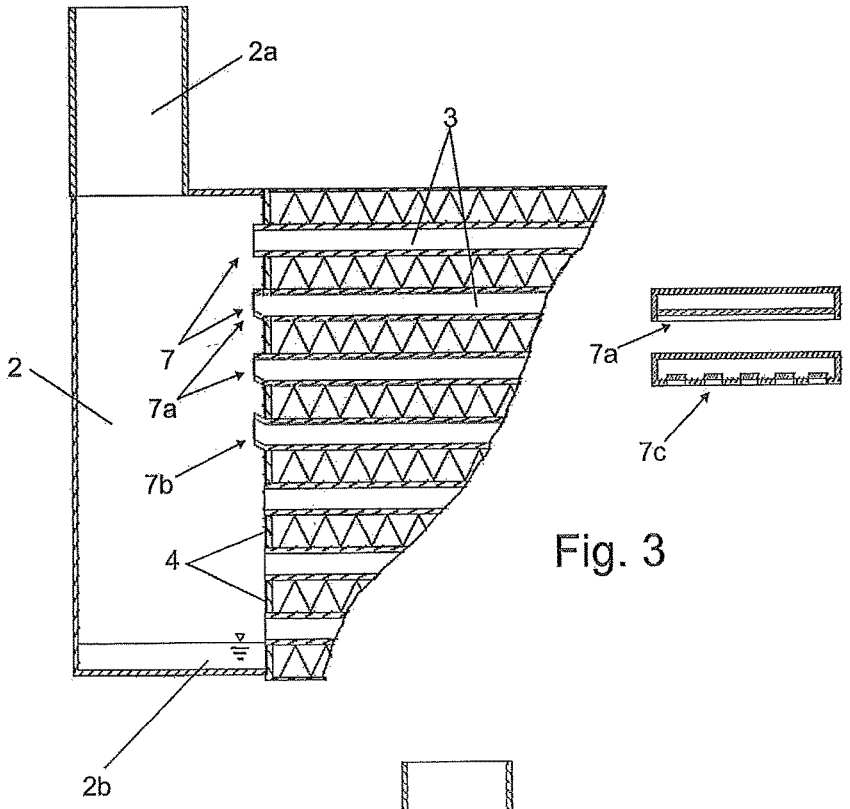
FIG. 3 shows a second exemplary embodiment of a heat exchanger according to the invention, having multiple alternative or additional modifications.

In a first exemplary embodiment according to FIG. 3, it is generally provided that tubes 3 have a projection 7 beyond base 4 at least in the area of collector box 2 on the output side, via which the tubes extend into collector box 2 and the gas flow located therein. Improved atomization of the condensation accumulating in tube 3 is thereby achieved at the edge of the end of the tube.

In a first modification 7*a* (see top view of a tube end in FIG. 3), a lower edge of flat tube 3 is bent upward, which achieves a nozzle-like cross-sectional constriction at the end of the tube and further improves atomization. In a further modification 7*b*, both long edges of the end of flat tube 3 are bent upward, which, on the one hand, improves atomization and, on the other hand, deflects the gas flow in the direction of outlet 2*a*.

In a further detail design, at least the lower edge of the flat tube end is provided, in the present case, with a crenellated corrugation 7*c*, which achieves a further improved atomization of the condensation accumulating on the end of the tube.

Figure 4:
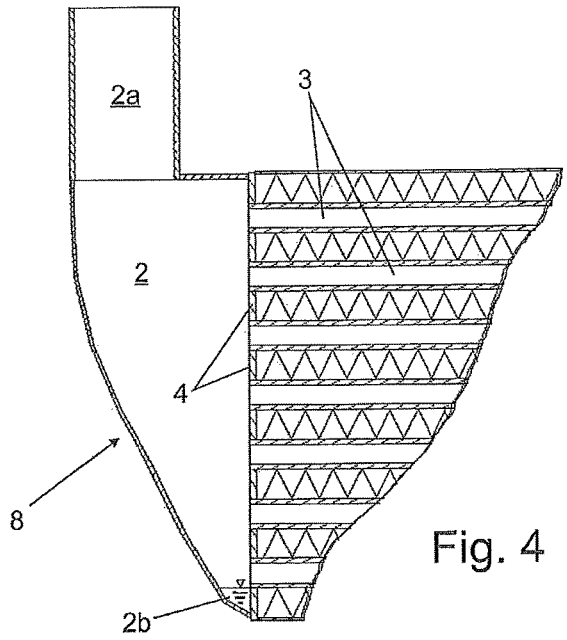
FIG. 4 through FIG. 14 show further exemplary embodiments of a heat exchanger according to the invention.

In the exemplary embodiment according to FIG. 4, collector box 2 is designed in such a way that its flow cross-section increases continuously from a lower sump 2*b* in the direction of outlet 2*a*, so that a uniform flow velocity of the gas is achieved in collector box 2 on the basis of successively emptying tubes 3. For this purpose, wall 8 of collector box 2 opposite tubes 3 is designed to be inclined [in a direction] perpendicular to tubes 3 or to the plane of base 4. This has the additionally advantageous effect that the incident gas flow grazes the entire length of wall 8, so that a condensation film forming on wall 8 is better transported in the direction of outlet 2*a*, in particular against gravity.

Figure 6:
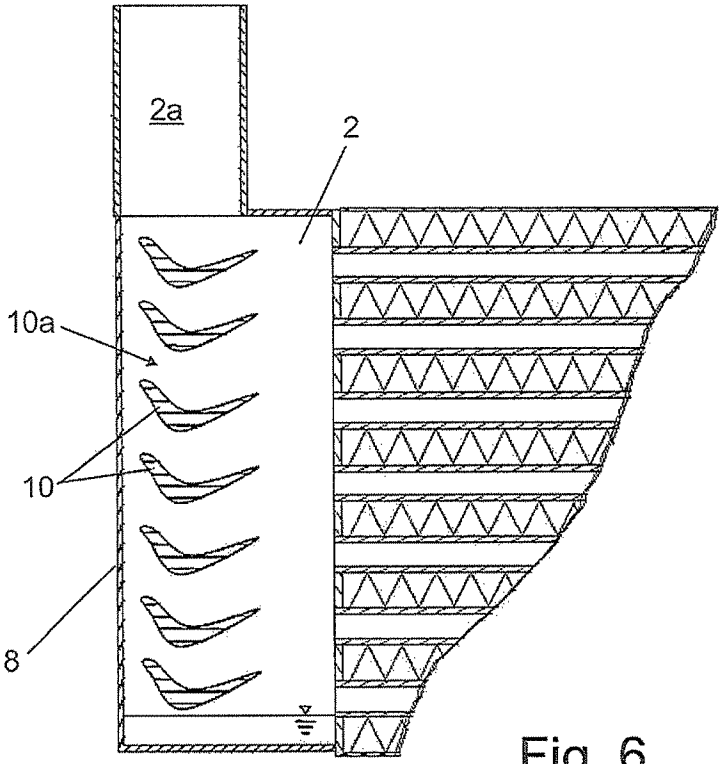
Figure 5:
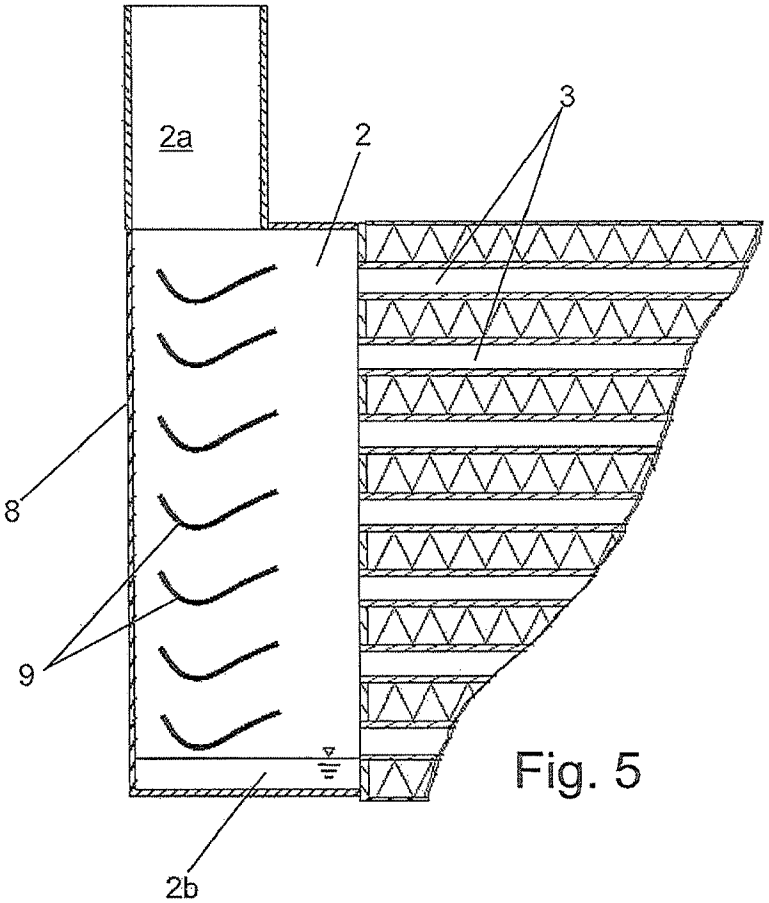

In the exemplary embodiments according to FIG. 5 and according to FIG. 6, conducting means 9, 10 are each situated in collector box 2. In the first example according to FIG. 5, conducting members 9 are designed as bent conducting plates which intensively conduct the gas flow exiting tubes 3 to opposite wall 8 of collector box 2. A condensation film located on wall 8 is transported more effectively hereby to outlet 2*a*. In the case of conducting vanes 10 according to FIG. 6, the shape of conducting vanes 10 additionally achieves a constriction 10*a* between adjacent vanes, so that local increases in the flow velocity are achieved for the gas flow in collector box 2. In a suitable design, this also achieves a further improvement in the transport of condensation along wall 8. Conducting vanes 10 may be made, for example, of plastic molded parts. In principle, conducting members 9, 10 may be designed to be integrated into the collector box, which may also be, for example a plastic molded part, for example made of a polyamide.

Figure 7:
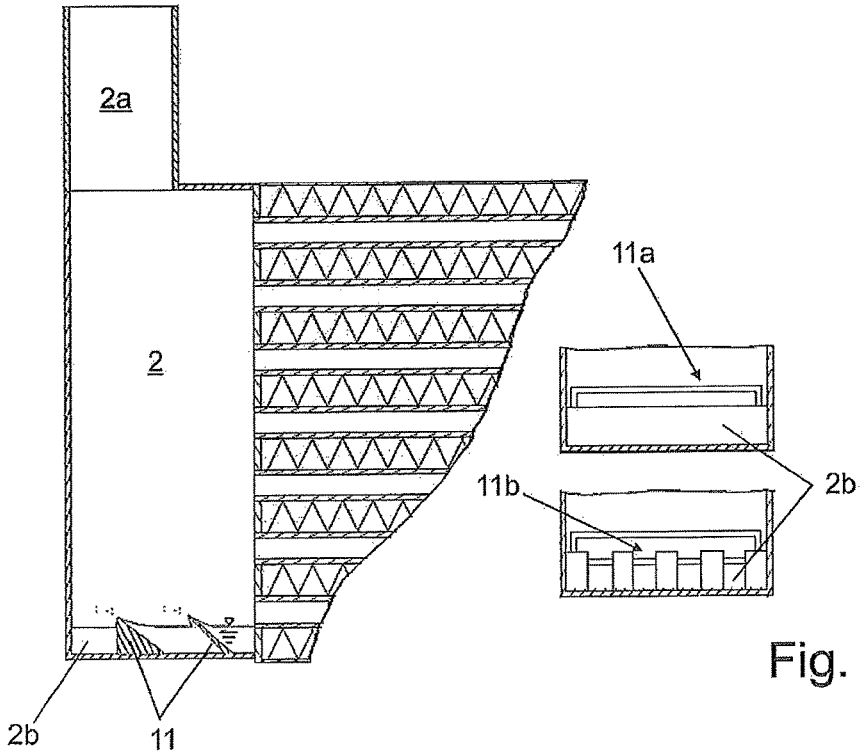

In the exemplary embodiment according to FIG. 7, separation edges 11 of different shapes are provided in the area of sump 2*b* of collector box 2, these separation edges extending continuously over the entire width of the collector box in the case of a first detail design 11*a* (see detail representation of the separation edge in the top view) and having crenellated interruptions for the purpose of further improving their function in the case of a second detail design 11*b*. Due to these separation edges, the condensation of sump 2*b* may be atomized with the aid of the gas flow, thereby improving the removal of condensation from the sump with the aid of the gas flow.

FIG. 8 through FIG. 11 each show exemplary embodiments in which a condensation channel 12 is provided which extends from sump 2*b* to outlet 2*a*. The gas flow in outlet 2*a* passes over an end 12*a* of condensation channel 12 on the outlet side at a relatively high velocity, so that a low pressure is provided in condensation channel 12 by means of which the condensation is extracted from sump 2*b* to outlet 2*a*.

Figure 8:
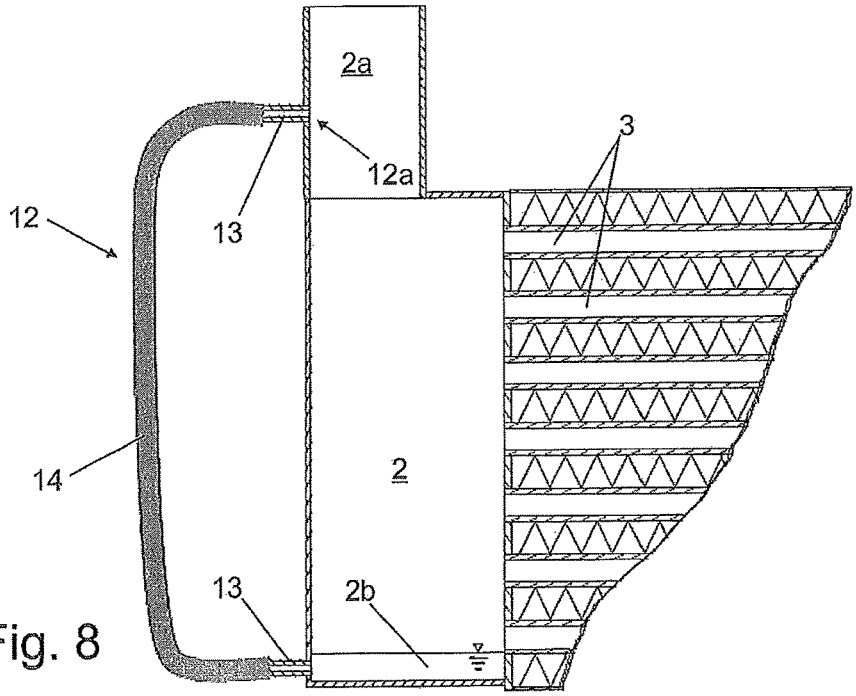
Figure 10:
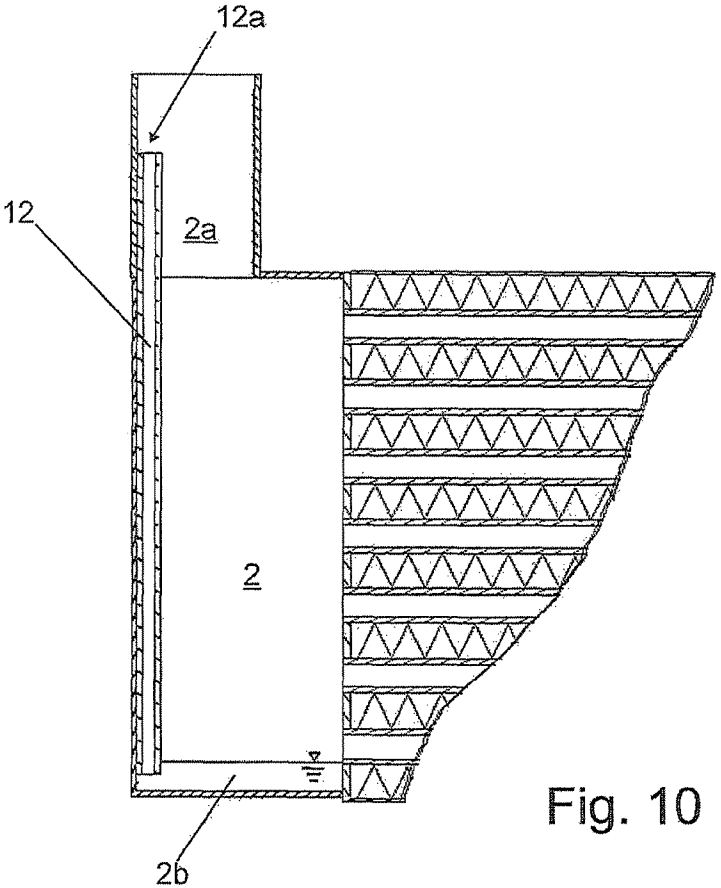
Figure 9:
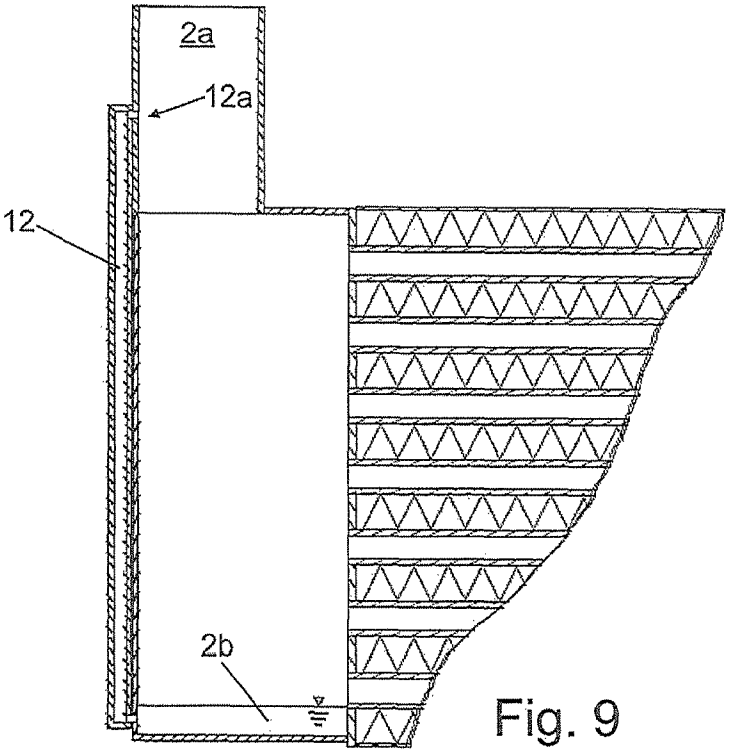

Depending on the requirements, the condensation channel may be designed according to FIG. 8 as an external line, in the present case in the form of a hose 14 connected to a connecting piece 13. Alternatively, it may also be designed to be integrated with collector box 2 on the outside of collector box 2 according to FIG. 9 or on the inside of collector box 2 according to FIG. 10. Depending on the design of the collector box, this may be accomplished using metal sheets or by an integrated design in the form of a plastic casting or the like.

Figure 11:
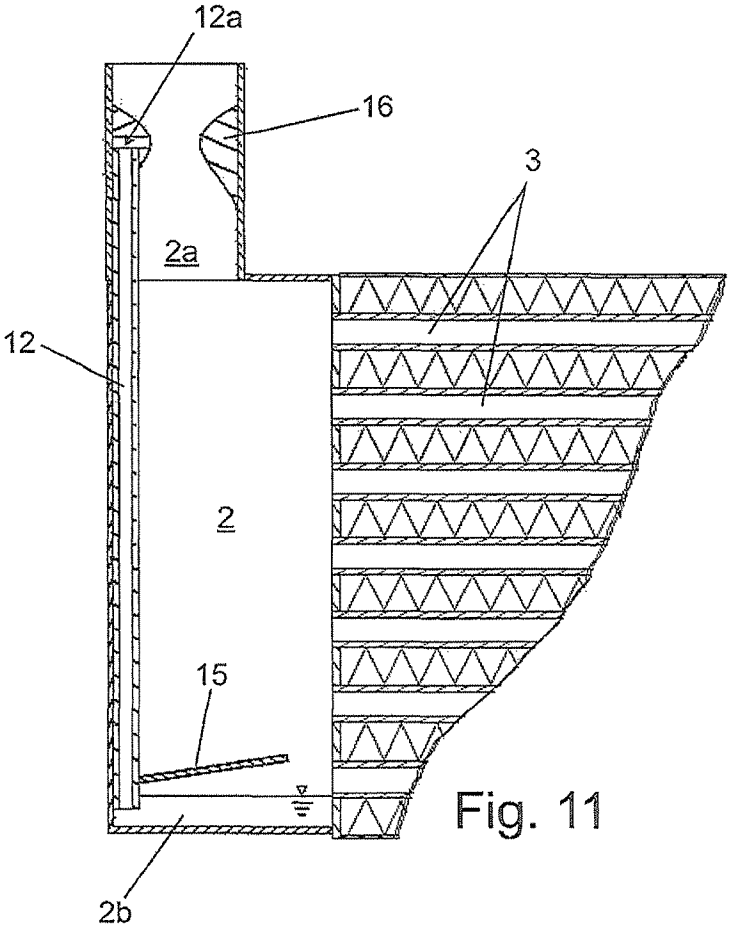

In the example according to FIG. 11, a retaining member 15 is additionally provided in the area of the sump, by means of which the gas flow exiting tubes 3 in the lower collector box area is retained so that an improved removal of the condensation through condensation channel 12 is achieved by static pressure on the fluid surface of sump 2*b*. The suction effect in outlet 2*a* at end 12*a* of the condensation channel is further improved by a nozzle-like cross-sectional constriction 16 in outlet 2*a*. The velocity of the gas flow in the area of condensation channel end 12*a* and thus the low pressure produced therein are increased by cross-sectional constriction 16.

Figure 12:
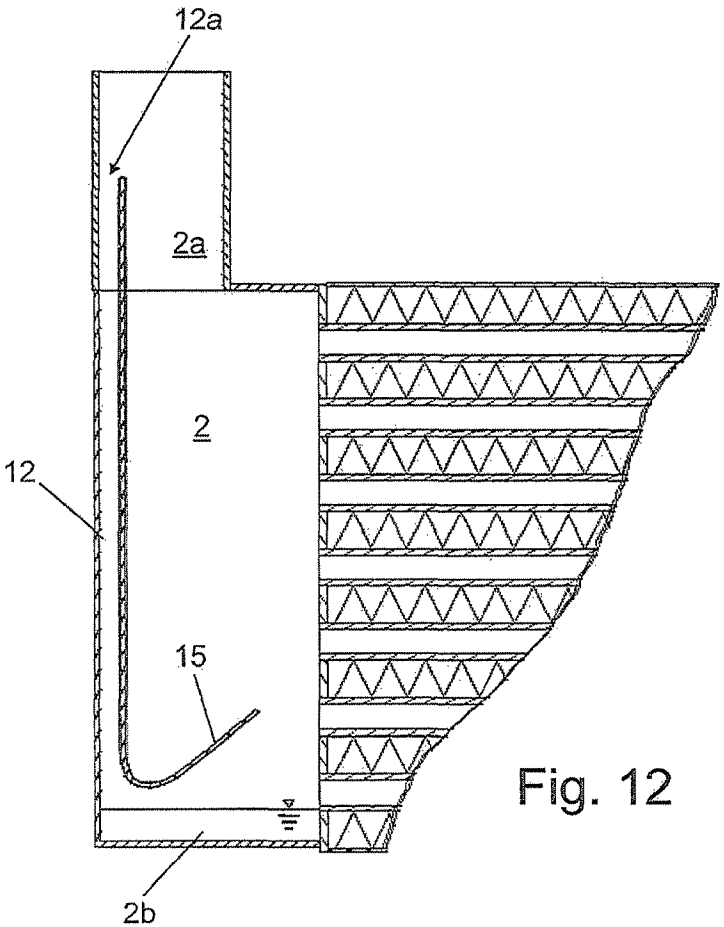

FIG. 12 shows a variant of the condensation channel illustrated in FIG. 11, in which the condensation is transported primarily by atomizing and carrying along fluid droplets and by driving a water film. If the sump level rises due to heavy condensation, the increasing constriction between the water level and retaining member achieves a greater flow velocity and increased transport of condensation. If the level increases even further and completely closes the cross-section, the condensation is further removed in the same manner as in FIG. 11.

In the example according to FIG. 12, retaining member 15 and a wall of condensation channel 12 are provided with an integrated design in the form of a sheet metal molded part. Depending on the requirements, these elements may also be made of multiple components.

Figure 13:
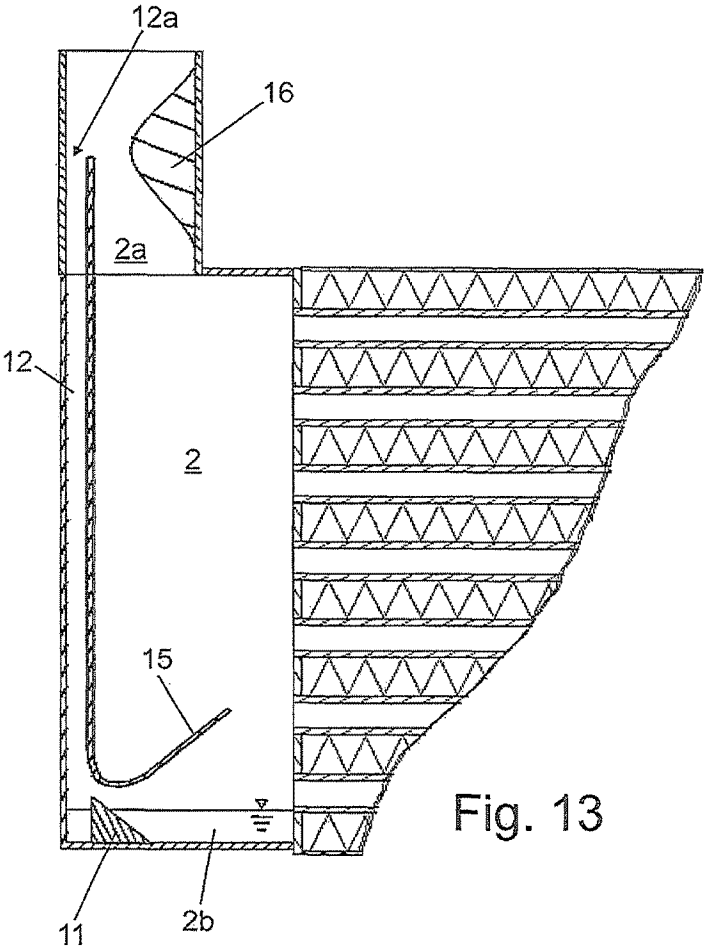

FIG. 13 shows an exemplary embodiment in which an integrated design of retaining member 15 and condensation channel 12 is provided and for which a separation edge 11 is provided in the area of sump 12*b* for the purpose of further improvement. Separation edge 11 forms a part of the lower inlet of condensation channel 12. A cross-sectional constriction 16 is also provided in the area of outlet 2*a*. On the whole, the example according to FIG. 13 thus combines features from the examples according to FIG. 7, FIG. 11 and FIG. 12.

Figure 14:
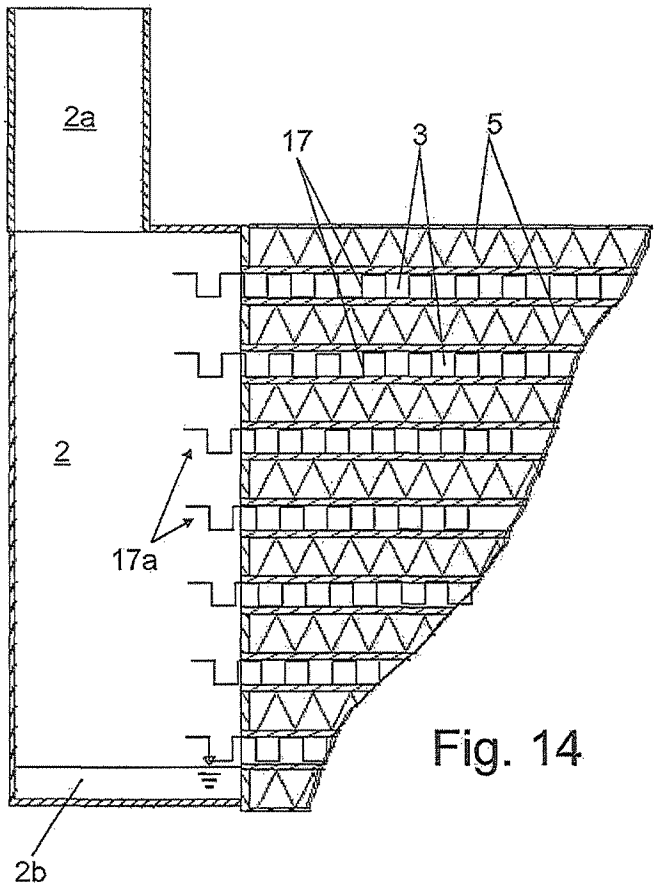

In the exemplary embodiment according to FIG. 14, a turbulence member 17 in the form of an inserted and soldered inner fin, in the present case a connecting fin, is provided in some of tubes 3. According to the invention, a projection 17*a* of the connecting fin extends beyond the tube end and into collector box 2 on the outlet side. The condensation accumulating on the inner walls of tubes 3 is driven by the gas flow within the tubes to the tube end, from where the condensation flows onto projection 17*a* of the connecting fin, from where it is atomized and/or vaporized by the gas flow. Projections 17*a* may also be bent upward (not illustrated), in particular in the direction of outlet 2*a*, so that effects of conducting members are simultaneously achieved by projections 17*a*, having in particular the effect according to the exemplary embodiments in FIG. 5 and FIG. 6.

It is understood that the features of the individual exemplary embodiments may be reasonably combined with each other, depending on the requirements.

Although the heat exchanger according to the invention is illustrated in all exemplary embodiments as a direct charge air cooler or a charge air cooler through which air flows, any other design is also possible, in particular the design of a direct or fluid-cooled charge air cooler or exhaust gas cooler.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger for an internal combustion engine, the heat exchanger comprising:

at least one collector box provided on an output side, the collector box having a bottom surface, an upper surface that opposes the bottom surface and side surfaces arranged perpendicular to the bottom surface and the upper surface;

a plurality of substantially parallel tubes positioned outside of the collector box, the tubes each emptying directly into the collector box at one of the side surfaces of the collector box, such that an end of each tube opens into the collector box, wherein a gas flow flows from the tubes into the collector box and from the collector box into an outlet of the collector box; and a structure configured to interact with the gas flow is provided at at least one of the tubes or another one of the side surfaces of the collector box, the structure configured to transport a condensation to the outlet, wherein the outlet projects outward from the upper surface of the collector box, such that an extending direction of the outlet is perpendicular to an extending direction of the plurality of tubes, wherein a width of the outlet is greater than a width of the structure, wherein an upper end of the structure is positioned inside of the outlet, such that the condensation is transported into the outlet from the upper end of the structure, wherein the gas flow flows into the outlet directly from the collector box, such that the gas flow bypasses the structure, and wherein the collector box is completely enclosed by the side surfaces, the upper surface and the bottom surface except for openings provided to accommodate the end of each tube that opens into the collector box at the one side surface and the outlet that projects from the upper surface of the collector box.

2. The heat exchanger according to claim 1, wherein the structure includes a projection of the tubes into the collector box.

3. The heat exchanger according to claim 1, wherein the structure includes a modulation of an edge of at least one of the tubes on the outlet side, in particular an upward bending of the edge and/or a corrugation.

4. The heat exchanger according to claim 1, wherein the collector box is configured as a longitudinal cavity, a cross-section of the collector box increasing over the area of the emptying tubes in a direction of the gas flow.

5. The heat exchanger according to claim 4, wherein a wall of the collector box opposite the tubes is inclined in a direction perpendicular to the tubes.

6. The heat exchanger according to claim 1, wherein the structure includes at least one conducting member provided in the collector box, the gas flow being guided in a grazing manner along a wall of the collector box via the conducting member.

7. The heat exchanger according to claim 6, wherein the conducting member is configured as a conducting plate or as a conducting vane.

8. The heat exchanger according to claim 1, wherein the collector box has a sump for the condensation, the structure being configured as at least one separation edge provided in the area of the sump.

9. The heat exchanger according to claim 1, wherein the collector has a sump for the condensation, the structure including a condensation channel that leads from the sump to the outlet, and wherein the gas flow passes over an end of the condensation channel on the outlet side.

10. The heat exchanger according to claim 9, wherein a section of the condensation channel is configured as a separate channel or a channel integrated into the wall of the collector box on an outside or on an inside of the collector box.

11. The heat exchanger according to claim 9, wherein a retaining member is provided immediately above the sump for influencing a pressure in the area of the sump, the retaining member configured to be integrated with a wall of the condensation channel.

12. The heat exchanger according to claim 9, wherein a nozzle-like cross-sectional constriction of the outlet is provided in an area of the end of the condensation channel on the outlet side.

13. The heat exchanger according to claim 9, wherein the condensation channel is a tube, a portion of the tube being attached to an inner surface of the collector box such that the condensation channel is integrated to an inside of the collector box.

14. The heat exchanger according to claim 1, wherein a turbulence member configured as an inner fin is inserted into each of the tubes, the turbulence member having a projection over the end of the tube and extending into the collector box.

15. The heat exchanger according to claim 14, wherein the projection of the turbulence member is provided with a bend in the direction of the outlet.

16. The heat exchanger according to claim 1, wherein the collector box extends substantially in the direction of gravity, the tubes extending in a substantially horizontal direction.

17. The heat exchanger according to claim 1, wherein the outlet is smaller in cross-section than the collector box.

18. The heat exchanger according to claim 1, wherein the upper end of the structure terminates inside of the outlet.

19. The heat exchanger according to claim 1, wherein the structure is attached directly to the collector box.

20. The heat exchanger according to claim 1, wherein the outlet directly contacts the collector box.

21. The heat exchanger according to claim 1, wherein the upper end of the structure projects outward from the upper surface of the collector box.

* * * * *